US007028875B1

(12) United States Patent
Beville et al.

(10) Patent No.: US 7,028,875 B1
(45) Date of Patent: Apr. 18, 2006

(54) NAIL CHECKER ASSEMBLY

(75) Inventors: John M. Beville, Jackson, TN (US); Patrick G. Barry, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/665,139

(22) Filed: Sep. 17, 2003

Related U.S. Application Data

(60) Provisional application No. 60/411,563, filed on Sep. 18, 2002, provisional application No. 60/471,641, filed on May 19, 2003.

(51) Int. Cl.
*B25C 1/04* (2006.01)

(52) U.S. Cl. ..... 227/8; 227/119; 227/120

(58) Field of Classification Search ..... 227/2, 227/8, 110, 119, 120, 109, 136, 156
See application file for complete search history.

(56) References Cited

U.S. PATENT DOCUMENTS

| | | | | | |
|---|---|---|---|---|---|
| 4,949,780 | A | | 8/1990 | Chen | 165/7 |
| D323,835 | S | | 2/1992 | Leu | D15/133 |
| 5,240,161 | A | * | 8/1993 | Kaneko | 227/109 |
| 5,241,888 | A | | 9/1993 | Chen | 83/471.3 |
| D351,605 | S | | 10/1994 | Chen | D15/138 |
| D368,701 | S | | 4/1996 | Foy | D14/100 |
| 5,579,975 | A | * | 12/1996 | Moorman | 227/8 |
| D386,192 | S | | 11/1997 | Chen | D15/132 |
| 5,687,899 | A | * | 11/1997 | Dohi et al. | 227/8 |
| 5,694,714 | A | | 12/1997 | Basso et al. | 43/26.2 |
| D389,494 | S | | 1/1998 | Chen | D15/133 |
| D391,585 | S | | 3/1998 | Chen | D15/133 |
| D393,648 | S | | 4/1998 | Chen | D15/132 |
| 5,778,747 | A | | 7/1998 | Chen | 83/471.3 |
| 5,778,752 | A | | 7/1998 | Chen | 83/783 |
| D397,343 | S | | 8/1998 | Chen | D15/133 |
| 5,836,501 | A | | 11/1998 | Lai | 227/8 |
| 5,881,941 | A | | 3/1999 | Lai | 227/130 |
| 5,924,621 | A | | 7/1999 | Hung | 227/130 |
| 5,934,539 | A | | 8/1999 | Lee | 227/109 |
| 6,024,268 | A | | 2/2000 | Horng-Lin | 227/120 |
| 6,024,269 | A | | 2/2000 | Ho et al. | 227/130 |
| 6,059,166 | A | | 5/2000 | Ho et al. | 227/130 |
| 6,059,167 | A | | 5/2000 | Ho et al. | 227/130 |
| 6,089,436 | A | | 7/2000 | Ho et al. | 227/130 |
| 6,149,046 | A | | 11/2000 | Ho et al. | 227/8 |
| 6,170,729 | B1 | | 1/2001 | Lin | 227/8 |
| 6,170,730 | B1 | | 1/2001 | Lin | 227/119 |
| 6,173,963 | B1 | | 1/2001 | Ho et al. | 277/361 |
| D442,190 | S | | 5/2001 | Chen | D15/133 |
| 6,264,085 | B1 | | 7/2001 | Ho et al. | 227/8 |
| 6,290,115 | B1 | | 9/2001 | Chen | 227/120 |
| 6,296,168 | B1 | | 10/2001 | Hung | 227/130 |
| D453,345 | S | | 2/2002 | Chen | D15/133 |

(Continued)

*Primary Examiner*—Scott A. Smith
(74) *Attorney, Agent, or Firm*—Suiter West Swantz pc llo

(57) ABSTRACT

A nail checker assembly, disposed with a nail loading assembly, provides a pivoting probe assembly which engages with a nail, advancing down the nail loading assembly, and determines if the nail is correctly aligned. If the nail is properly aligned the pivoting probe assembly, coupled with a pivoting probe base assembly, rotates and allows the nail to advance. If the nail is improperly aligned the pivoting probe assembly engages with a lock ledge assembly providing a stop and hindering the advancement of the nail.

13 Claims, 8 Drawing Sheets

U.S. PATENT DOCUMENTS 6,392,381 B1 5/2002 Chen ..... 320/111
6,397,954 B1 6/2002 Liu ..... 173/93.5
6,431,428 B1 8/2002 Chen ..... 227/120
6,502,737 B1 * 1/2003 Akiba ..... 227/109
6,641,022 B1 * 11/2003 Hamano et al. ..... 227/120
6,655,572 B1 * 12/2003 Amada ..... 227/120
6,685,078 B1 * 2/2004 Wohlwend et al. ..... 227/109
6,708,860 B1 * 3/2004 Thieleke ..... 227/120
6,708,861 B1 * 3/2004 Osuga et al. ..... 227/120
6,729,524 B1 * 5/2004 Yao ..... 227/120
6,739,490 B1 * 5/2004 Shkolnikov et al. ..... 227/2
6,789,718 B1 * 9/2004 Canlas et al. ..... 227/130

* cited by examiner

NAIL CHECKER ASSEMBLY

CROSS REFERENCE TO RELATED APPLICATION

The present application claims priority under 35 U.S.C. §119(e) to the U.S. Provisional Application Ser. No. 60/411,563, filed on Sep. 18, 2002, and the U.S. Provisional Application Ser. No. 60/471,641, filed on May 19, 2003. The U.S. Provisional Application 60/411,563 and 60/471,641 are herein incorporated by reference in their entireties.

FIELD OF THE INVENTION

The present invention generally relates to the field of power tools, and particularly to a nail checker assembly for use in a nail gun, such as a pneumatic nail gun.

BACKGROUND OF THE INVENTION

The use of power tools have greatly increased efficiency and productivity in various workplaces, but particularly in the field of construction. However, tools such as nail guns are often limited in the type of nail they may operate upon. Thus, when working with nail guns, such as pneumatic nail guns, it is crucial to load the correct collated nail strip. However, many times the wrong collated nail strip is loaded into the pneumatic nail gun resulting in damage to the tool, decreased production, and increasing costs.

Many of the power tools, such as nail guns which employ instruments, such as nails, rely on the operator to determine the correct nail to employ. For instance, one nail gun may require the use of clipped head nails provided in a collated magazine at a specific angle. The operator of the nail gun is then required to provide these types of nails. The only verification is provided by the operator's skill, knowledge, and experience with the nail gun. However, it may be the case that one operator is less experienced than another or that the nail gun is provided to the operator already loaded with nails. There have been no effective ways provided by the current state of the art to enable the tool to verify that the correct nails are being employed, regardless of the skill, knowledge, and experience of the operator.

Therefore, it would be desirable to provide a nail gun employing a system and method for assisting in determining if the proper nails are being employed, allowing those properly aligned to advance and hindering those improperly aligned from advancing.

SUMMARY OF THE INVENTION

Accordingly, the present invention is directed to a nail checker assembly for providing a way to increase the likelihood that the correct instrument (e.g., a nail or a nail strip) will be loaded and used by a nail gun. In this manner the nail gun provides assistance in verifying whether the nails are properly aligned with the tool or improperly aligned. If the nails are properly positioned, they are allowed to advance and be operated upon by the tool. If the nails are improperly positioned, the nail checker assembly hinders the nails from advancing. In a first aspect of the present invention, a nail checker assembly includes a pivoting probe assembly for engaging a nail advancing within a nail loading assembly. The pivoting probe assembly is coupled with a pivoting probe base assembly. The pivoting probe base assembly enables rotation of the pivoting probe assembly, the pivoting probe base assembly being coupled with a base assembly which is coupled with the nail loading assembly. The pivoting probe base assembly rotates relative to the base assembly. A lock ledge assembly is coupled with the base assembly and provides a stop when contacted by the pivoting probe assembly. The nail checker assembly allows the nail to advance when the nail correctly engages with the pivoting probe assembly.

In a second aspect of the present invention, an adjustable angle magazine is provided which adjustably couples to a nail driving assembly of a nail gun. The adjustable angle magazine comprises a housing including a first end and a second end, the housing stores a nail and provides the nail to the nail driving assembly. An adjustment assembly is disposed proximal to the second end of the housing, the adjustment assembly for affixing the position of the housing relative to the nail gun. A universal adapter assembly is coupled to a first end of the adjustable angle magazine and enables the pivoting coupling of the adjustable angle magazine with the nail driving assembly. A nail checker assembly including a pivoting probe assembly is disposed upon the housing and determines the positioning of the advancing nail. The advancing nail is allowed to advance when contacting the pivoting probe assembly of the nail checker assembly in the correct position.

In a third aspect of the present invention, an adjustable angle nail gun is provided. The adjustable angle nail gun comprises a handle with a first end and a second end coupled with a fastening assembly. A nail driving assembly including a driver blade is coupled with the first end of the handle and is for driving a nail. An adjustable angle nose casting assembly is coupled with the nail driving assembly. The adjustable angle nose casting assembly enables the operational engagement of the driver blade with the nail. An adjustable angle magazine for storing and providing the nail is pivotally coupled with the adjustable angle nose casting assembly. A universal adapter assembly is coupled with a first end of the adjustable angle magazine and enables the pivotal coupling of the adjustable angle magazine with the adjustable angle nose casting assembly. An adjustment assembly disposed proximal to the second end of the adjustable angle magazine couples with the fastening assembly A nail checker assembly including a pivoting probe assembly is disposed upon the housing and determines the positioning of the advancing nail. The advancing nail is allowed to advance when contacting the pivoting probe assembly of the nail checker assembly in the correct position.

In a fourth aspect of the present invention, a method for determining whether a proper collated nail strip has been loaded into a nail loading assembly for driving by a nail driving assembly of a nail gun. An operator of a nail gun selects and loads the collated nail strip into the nail loading assembly. As the nail strip advances through the nail loading assembly the nails are engaged by a nail checker assembly. The nail checker assembly determines whether the collated nail strip provides nails in the correct position for use by the nail gun. If the nails are correctly positioned then they are allowed to advance and be received into the nail driving assembly. If the nails are incorrectly positioned then they are hindered from advancing within the nail loading assembly.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference may now be made in detail to the presently preferred embodiments of the invention, examples of which are illustrated in the accompanying drawings.

Exemplary embodiments of the present invention are shown, providing the capability of assisting in determining that the proper nails are being loaded into a nail gun with a nail loading assembly set at a particular angle relative to a nose casting assembly. Engagement of a nail shank by the present invention may result in the nail being allowed to continue to advance or having its advancement hindered. This may assist an operator of the nail gun who either through inadvertence or incompetence has loaded the incorrect nails into the nail loading assembly. This may reduce the chances of misfiring of the nail gun which may result in damage to the nail gun.

Figure 1:
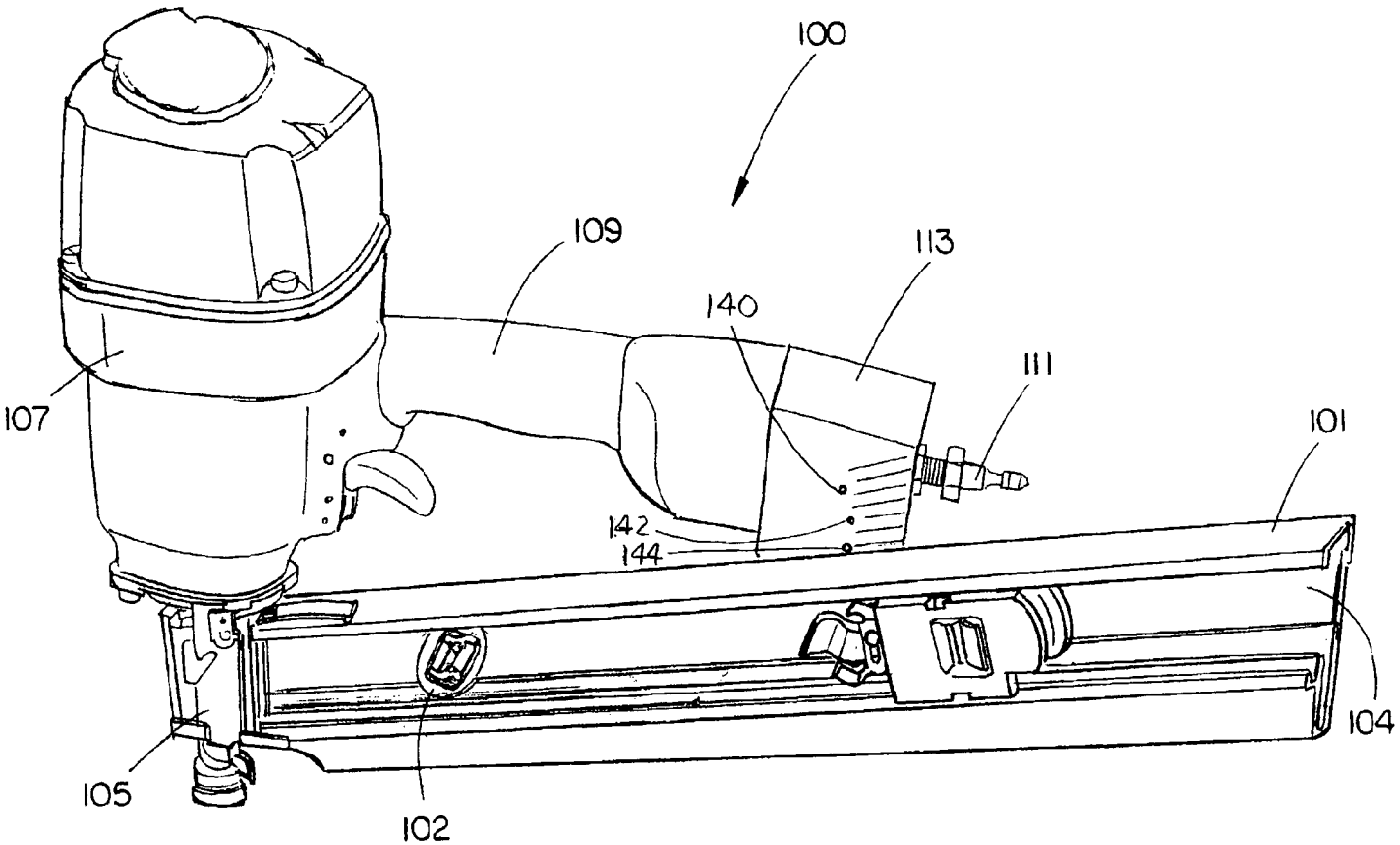
FIG. 1 is an illustration of a nail gun comprising an adjustable angle magazine including a nail checker assembly in accordance with an exemplary embodiment of the present invention.
Figure 2A:
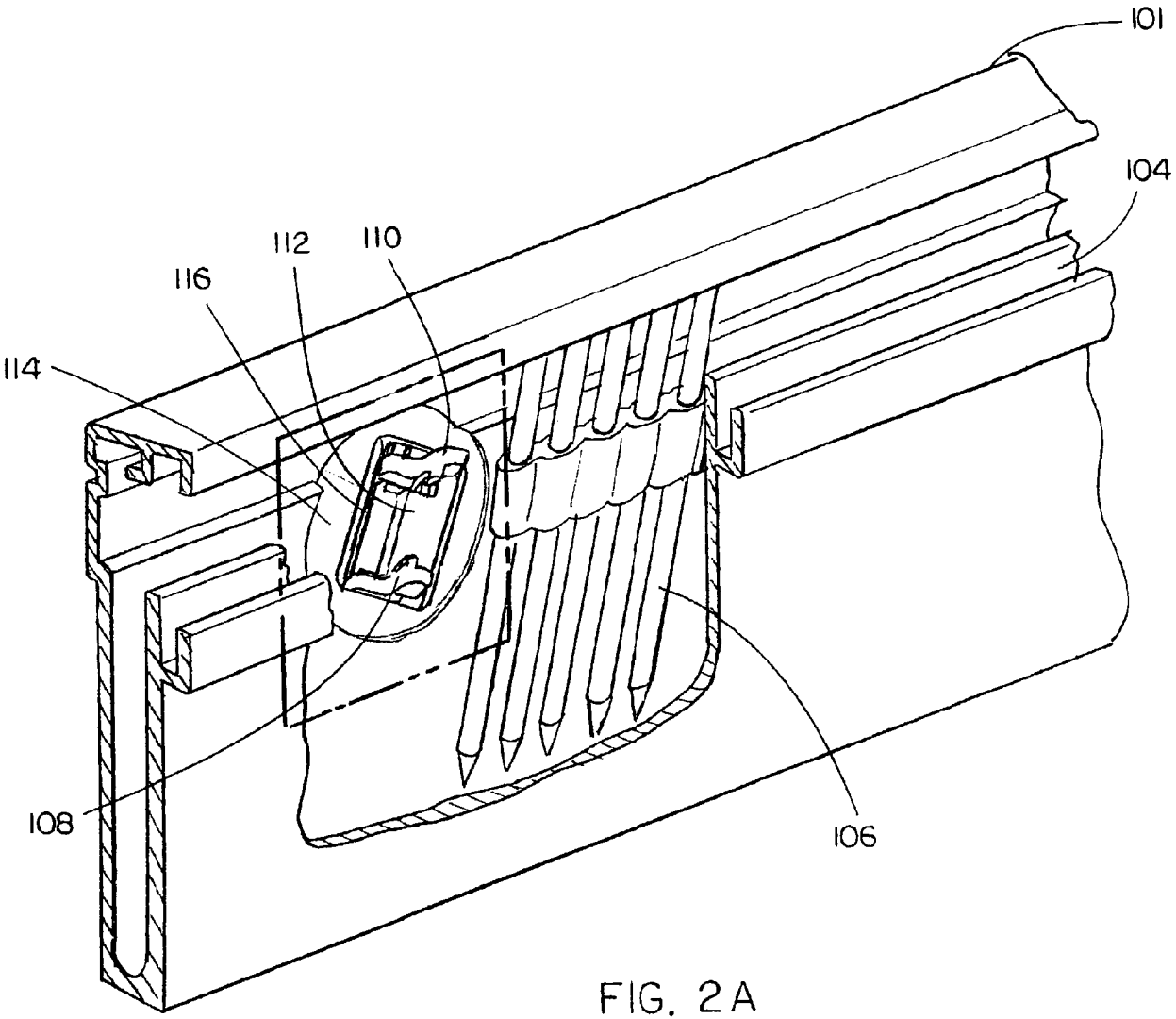
FIG. 2A is an expanded view of the nail checker assembly of FIG. 1.
Figure 2B:
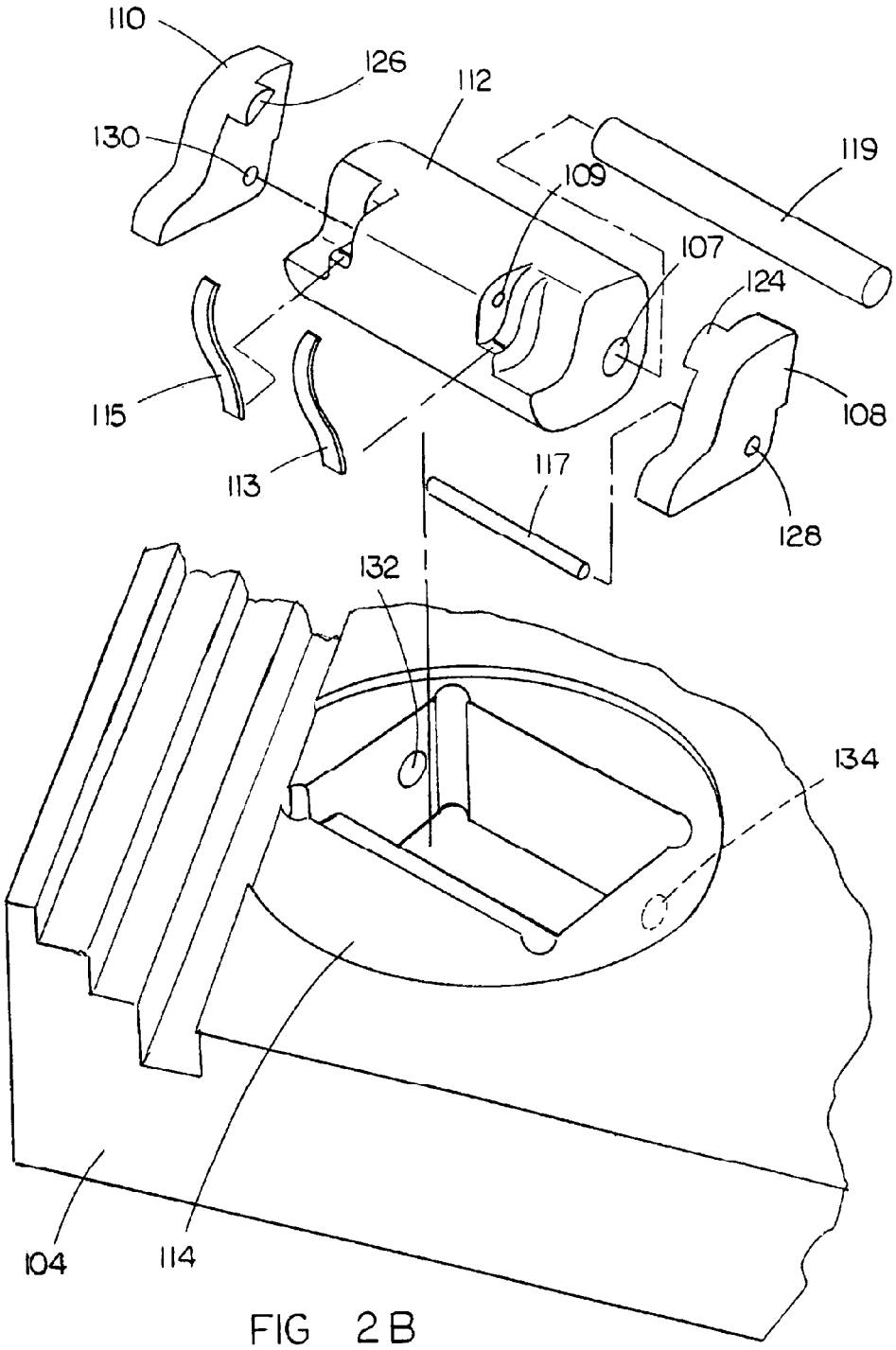
FIG. 2B is an exploded view of the nail checker assembly of FIG. 1.

Referring now to FIG. 1 a nail gun 100 is shown. The nail gun 100 includes a nail loading assembly 101 comprising a housing 104. In preferred embodiments, the nail gun 100 is an adjustable angle nail gun and the nail loading assembly is an adjustable angle nail loading assembly, such as an adjustable angle magazine. The adjustable angle magazine 101 may further include a variety of features, such as a pick-off pivot assembly, an articulating pusher assembly, and the adjustable angle magazine may be configured as a top-load or side-load magazine. A cover may engage with the housing 104 utilizing a variety of coupling methods as contemplated by one of ordinary skill. The nail loading assembly is disposed with a nail checker assembly 102. The nail gun further comprises a nose casting assembly 105 to which the nail loading assembly is coupled. The nose casting assembly 105 is preferably configured as an adjustable angle nose casting assembly so as to enable the angular adjustment of the adjustable angle nail loading assembly relative to it. The casing 107 is disposed with a nail driving assembly which couples with a handle 109. The handle 109 couples with an air compressor assembly 111 and a fastening assembly 113 which couples with the adjustable angle magazine 101. It is understood that the nail gun may be a pneumatic nail gun, a spring loaded nail gun, an electro-magnetic nail gun, or a combustion nail gun.

The fastening assembly 113 includes a plurality of angular adjustment sites, as exemplified by a first angular adjustment site 140, a second angular adjustment site 142 and a third angular adjustment site 144. The fastening assembly 113 is disposed with a plurality of angle identifiers. The angle identifiers are a series of indicators associated with a printed number (i.e., 30, 29, 28, 27 . . . ) which corresponds to the angle of presentation of the adjustable angle magazine 101 to the adjustable angle nose casting assembly 105. It is contemplated that the angle identifiers may be a label with the numbers printed upon them which may be adhered to the fastening assembly 113. Alternatively, the numbers may be engraved or painted upon the fastening assembly 113.

In the current embodiment, it is understood that the plurality of angular adjustment sites may be engaged by a fastener, such as a bolt, screw, pin, and the like. The fastener may engage through the housing 104 via an adjustment assembly comprising a first angular connection site and a second angular connection site. Alternatively, the number of angular connection sites may vary as contemplated by one of ordinary skill. The fastener engages through the first or second angular connection site and connects with one of the plurality of angular adjustment sites.

In an alternative embodiment, the fastening assembly employed by the present invention may be variously configured. For example, the fastening assembly may be implemented using a worm drive assembly. In such a configuration, a threaded shaft may be disposed within the fastening assembly and operationally coupled with a threaded sleeve. The threaded sleeve may be enabled to move up and down the threaded shaft through rotation of a mechanical rotation assembly, which couples with the threaded shaft, by an operator of the nail gun. Other configurations may include a pneumatic fastening system, hydraulic fastening system, alternative mechanical systems, and the like. For instance, the fastening assembly may utilize the compressed air provided through the compressor connection assembly by redirecting the flow of a portion of the compressed air into a gauge assembly. The gauge assembly may include a readout which provides a visual indication to the operator of the angle of the nail loading assembly relative to the adjustable angle nose casting assembly of the adjustable angle nail gun. Further, the gauge assembly may include an actuator which may allow the operator of the adjustable angle nail gun to alter the flow of the compressed air into the gauge assembly either increasing or decreasing the flow. Alternatively, the gauge assembly may provide a bleed-off valve assembly enabling the operator to regulate the release of the compressed air in the gauge assembly. Either by increasing and decreasing the air flow or bleeding-off the compressed air the operator may change the angle of the adjustable angle magazine relative to the adjustable angle nose casting assembly. The gauge assembly may control the angle of the adjustable angle magazine via a piston assembly engaging with the housing of the adjustable angle magazine. The piston assembly may include a piston engaging a shaft which is coupled with the housing, thus, as the shaft moves so to does the housing of the adjustable angle magazine. It is understood the piston moves the shaft by reacting to changing air pressures within.

In an alternative embodiment, a mechanical fastening system may include a ratchet assembly with a hand brake.

The hand brake is engaged by the operator and through pressure applied to the hand brake the ratchet assembly raises or lowers the housing of the adjustable angle magazine. For example, the hand brake may include a spring loaded snap joint which provides incremental adjustments of the angle of the housing relative to the adjustable angle nose casting assembly. The spring loaded snap joint engages a multi-position actuator which engages the ratcheting assembly. The hand brake may be disposed on the handle of the nail gun assembly to provide easy access and control over the nail gun assembly during operation of the hand brake.

In an alternative embodiment, the nail gun may be a pneumatic nail gun. Further, the nail gun may be a spring-loaded nail gun assembly. The spring-loaded nail gun assembly utilizing electricity to drive a motor which may engage a spring that drives the driver blade. In another embodiment, the nail gun may be an electro-magnetic nail gun assembly utilizing a solenoid to provide the driving force to the driver blade. The solenoid may include an electro-magnetic coil with a sliding piston inside it. Other embodiments of the solenoid may include a spring assembly to draw the piston back in. In a still further embodiment, the nail gun may be a combustion nail gun assembly utilizing a piston driven by the firing of gas in a combustion chamber to drive the driver blade. It is contemplated that the nail gun may be configured as a motor driven nail gun. Thus, the nail gun may be configured with electric motors and the like. Further, the motors may include clutch assemblies for providing the needed force to operate the driver blade and drive a nail. The configuration of the motor and clutch assemblies employed may vary as contemplated by one of ordinary skill in the art without departing from the scope and spirit of the present invention.

Referring generally now to FIGS. 2A through 6, the nail checker assembly 102 includes a base assembly 114 disposed with a lock ledge 116. The base assembly 114 is coupled, via axle 119, with a pivoting probe base assembly 112. The axle 119 enables rotation of the pivoting probe base assembly 112 relative to the base assembly 114 by extending through a first rotational engagement assembly 107 disposed within the pivoting probe base assembly 112. Thus, rotation of the pivoting probe base assembly 112 occurs on an axis established by the location of the first rotational engagement assembly 107, which is different from that of the first and second probe 108 and 110, described below. In alternative embodiments the pivoting probe base assembly 112 may be coupled with the base assembly 114 through a variety of devices which enable rotation of the pivoting probe base assembly 112 and operation of the nail checker assembly 102. For example, a first and second axle may be disposed at either end of the pivoting probe base assembly 112 for rotationally engaging with the base assembly 114 or a spring loaded tensioning assembly may couple the two components together allowing for rotation.

In the current embodiment, the pivoting probe base assembly 112 is further coupled with a pivoting probe assembly comprising a first probe 108 and a second probe 110. The first and second probe 108 and 110 are coupled with the pivoting probe base assembly 112 via an axle 117. The axle 117 enables rotation of the first and second probe 108 and 110 relative to the pivoting probe base assembly 112 by extending through a second rotational engagement assembly 109 disposed within the pivoting probe base assembly 112. Thus, rotation of the first and second probes occurs on an axis established by the location of the second rotational engagement assembly 109, which is different from that of the pivoting probe base assembly 112 relative to the base assembly 114 described above. Alternatively, the first and second probe 108 and 110 may be coupled to the pivoting probe base assembly 112 by a variety of devices, such as those described above, which enable rotation of the probes and operation of the nail checker assembly. Each probe has a specific range of rotation and once a probe has rotated through that range, for instance due to engagement with an advancing nail, any further rotation may cause the probe to apply a force on the pivoting probe base assembly 112. This force may initiate the rotation of the pivoting probe base assembly 112 relative to the base assembly 114, via axle 119.

The pivoting probe assembly further comprises a first tensioning assembly 113 which is coupled with the pivoting probe base assembly 112 and operationally engages with the first probe 108. The first tensioning assembly 113 engages with a first tab member 124 which is integrally coupled with the first probe 108. Preferably, the first tab member 124 is of a size and configuration which provides full engagement with the first tensioning assembly 113 while maintaining the overall contoured appearance of the first probe 108. However, the first tab member 124 may appear in a variety of configurations and may be removable from the first probe 108. Still further, the pivoting probe assembly comprises a second tensioning assembly 115 which is coupled with the pivoting probe base assembly 112 and operationally engages with the second probe 110. The second tensioning assembly 115 engages with a second tab member 126 which is integrally coupled with the second probe 110. The second tab member 126 provides similar configurations as that described for the first tab member 124 above. The first and second tensioning assemblies, in the preferred embodiment, comprise metal members which couple with the base assembly 112 on one end and engage with the first and second tab members on the other end. The amount of tension each metal member provides may vary as contemplated by one of ordinary skill in the art. The configuration of the metal members is "S" shaped, in the current embodiment. However, alternate configurations may be employed without departing from the scope and spirit of the present invention.

The tensioning assemblies operate independently of each other in the preferred embodiment. Thus, the first and second probe 108 and 110 operate independently when engaging a collated nail strip 106, shown in FIG. 2A. This enables the nail checker assembly 102 as a double check system in a single assembly.

The base assembly 114 provides a rigid mount and couples the nail checker assembly 102 with the housing 104 of the adjustable angle magazine 101. Further, coupled to the base assembly 114 is a lock ledge assembly 116. The lock ledge assembly 116 is configured to engage the first or second probe 108 and 110. Engagement by either the first or the second probe 108 or 110 with the lock ledge assembly 116 occurs when the collated nail strip 106 engages only one of the probes, thereby indicating that the angle of the collated nail strip 106 is not correct for the angled position of the housing 104 relative to the nose casting 105 of the nail gun 100. By enabling independent rotational capabilities in the first and second probe 108 and 110, either probe may engage the lock ledge assembly 116 and, thereby, determine the advancement of the nail loaded into the housing 104. For example, if an incorrectly positioned nail is loaded into the housing 104 it may engage with only one of the probes. The probe engaged by the nail rotates and in making contact with the pivoting probe base assembly 112 initiates rotation of the pivoting probe base assembly 112. The probe which is not engaged with the nail is rotated into engagement with the lock ledge assembly 116 by the rotation of the pivoting probe base assembly 112, thereby hindering advancement of an incorrectly positioned nail. Either the first or the second probe may rotate and engage the lock ledge 116, independently of one another. Alternatively, when a correctly positioned nail engages the nail checker assembly 102 it may simultaneously engage both the first and the second probe 108 and 110. Then the first and second probe rotate past the lock ledge assembly 116 and contact the pivoting probe base assembly 112 initiating rotation of the pivoting probe base assembly 112. The rotation of the pivoting probe base assembly 112 through simultaneous contact by both probes results in the first and second probes being rotated out of the path of the advancing nail. This allows the correctly positioned nail to continue advancing in the housing 104 past the nail checker assembly 102 and to the nose casting assembly 105 where the nail may then be driven.

It is understood that the base assembly 114 includes an angle of engagement assembly. In a preferred embodiment, shown and described in FIG. 6, the angle of engagement assembly includes an adjustment handle 121. The angle of engagement assembly enables the base assembly 114 to rotate in the housing 104 of the nail loading assembly. The rotation of the base assembly 114 enables the first and second probes 110 and 112 to be aligned in correspondence with the type of nail being used in the collated nail strip 106. For example, an operator of a nail gun assembly employing the adjustable angle magazine 101 including the nail checker assembly 102 may select to use round-head nails for a project. The base assembly 114 may be rotated into a first position which sets the first and second probes 110 and 112 at an angle relative to the angle of the nails in the adjustable angle magazine 101 which may allow the nails to properly engage the nail checker assembly 102 and advance to the nail gun. The base assembly 114 may include a second position which enables the use of clipped-head nails with the nail gun employing the nail checker assembly 102. It is contemplated that the angle of engagement assembly may include a manual mechanism which requires the operator to set the position of the base assembly 112. It is further contemplated that the base assembly 112 is enabled by the angle of engagement assembly to rotate to the correct position due to the angle of the adjustable angle magazine 101 coupled to the nail gun.

The nail checker assembly 102 may disposed near a back end of the adjustable angle magazine 101 or near a front end which couples with the nose casting assembly 105. Located near the back end may be advantageous to the operator of the nail gun employing the adjustable angle magazine 101 in that the operator may determine if the correct collated nail strip is being employed before fully loading the entire magazine. In alternative embodiments, the nail checker assembly 102 may be fixedly coupled to the adjustable angle magazine 101 utilizing a variety of devices, such as screws, bolts, and the like. This may be advantageous when the nail checker assembly 102 is employed with a nail loading assembly which is fixed in its position relative to the nose casting assembly of the nail gun. Further, it is contemplated that the nail checker assembly 102 may be a modular system capable of interchangeably operating with various nail loading assemblies. This may help reduce operation costs and increase productivity at a work site.

Figure 3:
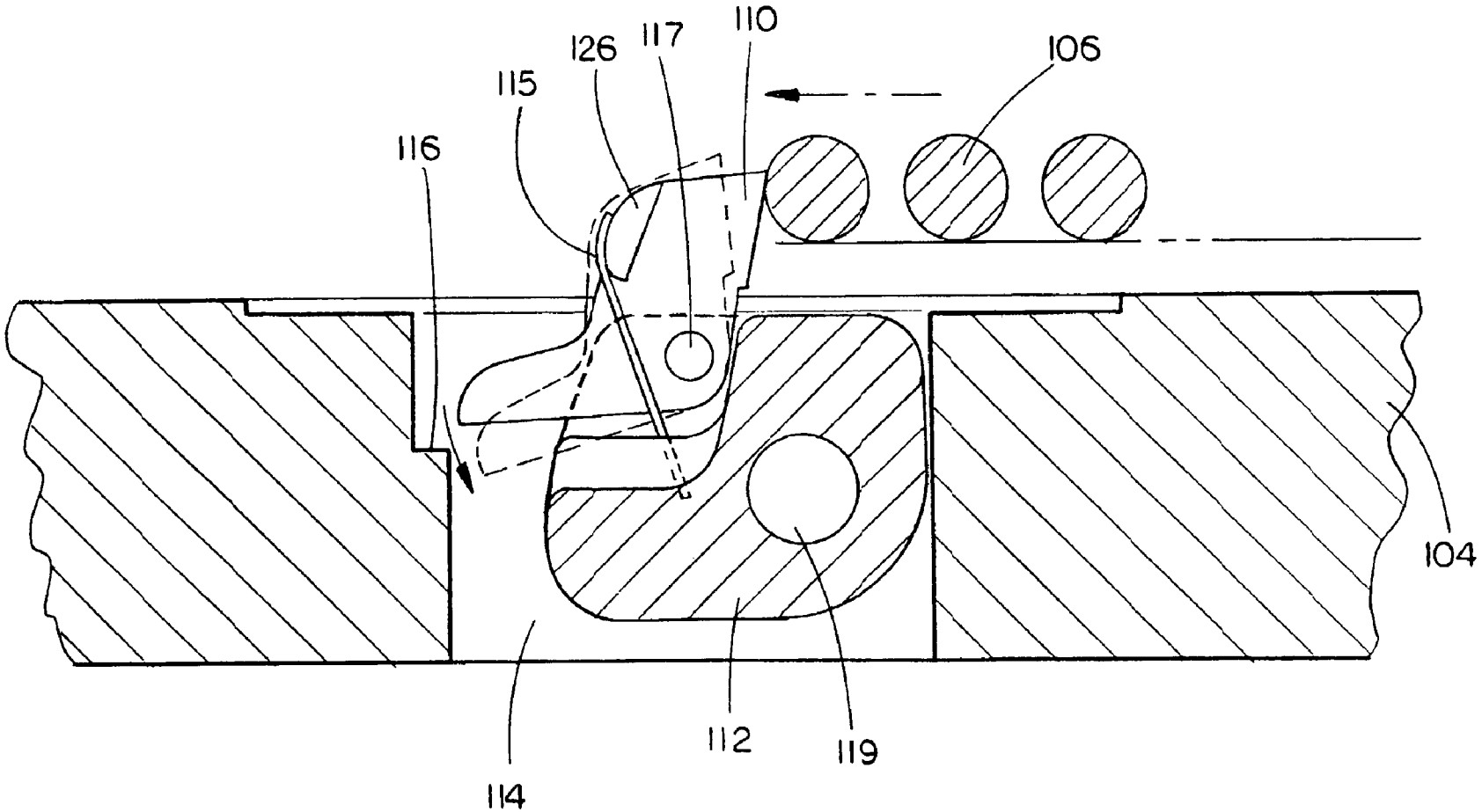
FIG. 3 is an illustration of a pivoting probe assembly of the nail checker assembly engaging a round-head nail and rotating past a lock ledge assembly.
Figure 4:
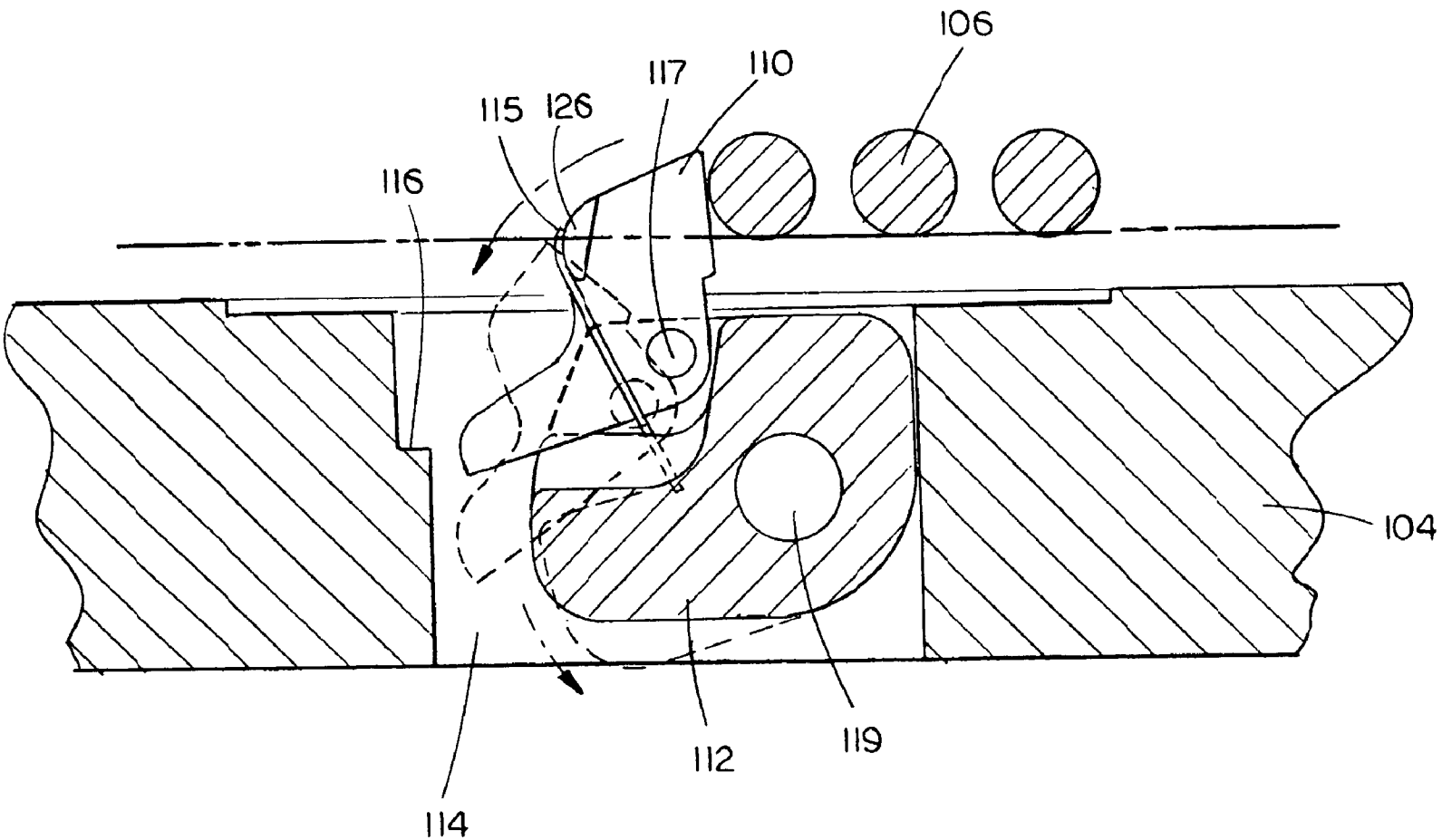
FIG. 4 is an illustration of the pivoting probe assembly and a pivoting probe base assembly rotating to allow the round-head nails to pass.

In FIGS. 3 and 4 the nail checker assembly 101 is shown engaging with a collated nail strip 106 of round-head nails. The first point of engagement is between the first nail and either the first or second probe 108 or 110. In FIGS. 3 and 4 the second probe 110 is shown engaging with the shank of the round-head nail. As shown in FIG. 3 this engagement initiates the rotation of the second probe 110 in a counter clockwise fashion. If the base assembly 114 has been set to the appropriate position for accepting round-head nails the advancing nail engages both the first probe 108 (not shown) and second probe 110 simultaneously. Such simultaneous engagement allows the first and second probe to simultaneously rotate past the lock ledge assembly 116. Once the first and second probes have rotated past the lock ledge assembly 116 they contact the pivoting probe base assembly 112 which initiates rotation in the pivoting probe base assembly 112. Like the rotation indicated for the second probe 110, the rotation of the pivoting probe base assembly 112 proceeds in a counter clockwise fashion. The rotation of the first and second probes and the pivoting probe base assembly 112 allows the round-head nail to pass and be engaged with the nail gun employing the adjustable angle magazine 101. Thus, the nails may engage both probes at the same time in order to allow the nails to advance. Because the torsional force holding the first and second probe 108 and 110 in its initial position is much less than the torsional force holding the pivoting probe base assembly 112 in its initial position, the pivoting probe base assembly 112 is hindered from rotating until either one or both probes have rotated to a point of engagement with the pivoting probe base assembly 112. Thus, rotation in the first and second probes occurs, at least initially, independent of the pivoting probe base assembly 112.

Figure 5A:
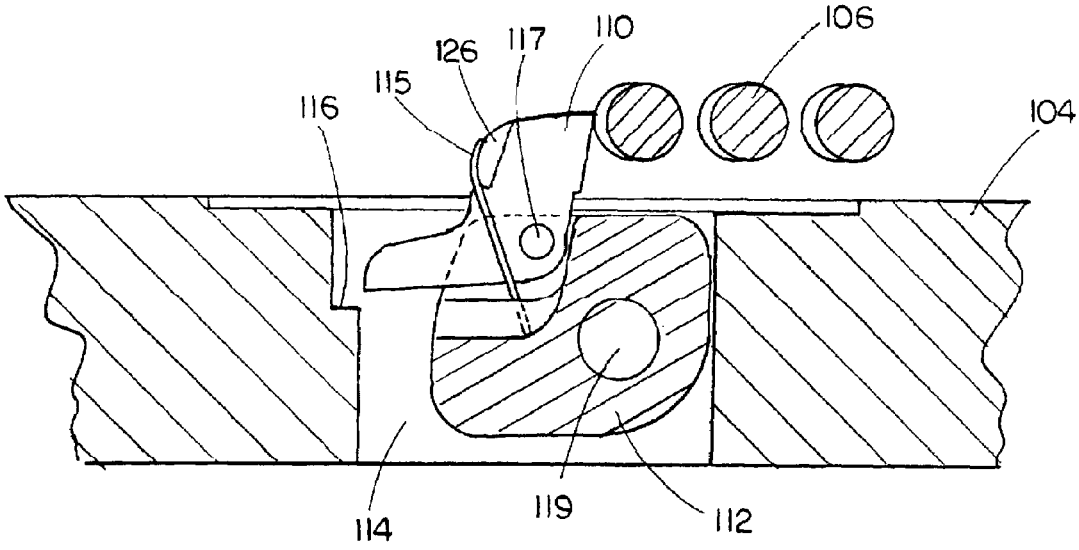
FIGS. 5A and 5B illustrate the pivoting probe assembly engaging a round-head nail and then engaging the lock ledge assembly to hinder the advancement of the round-head nails.
Figure 5B:
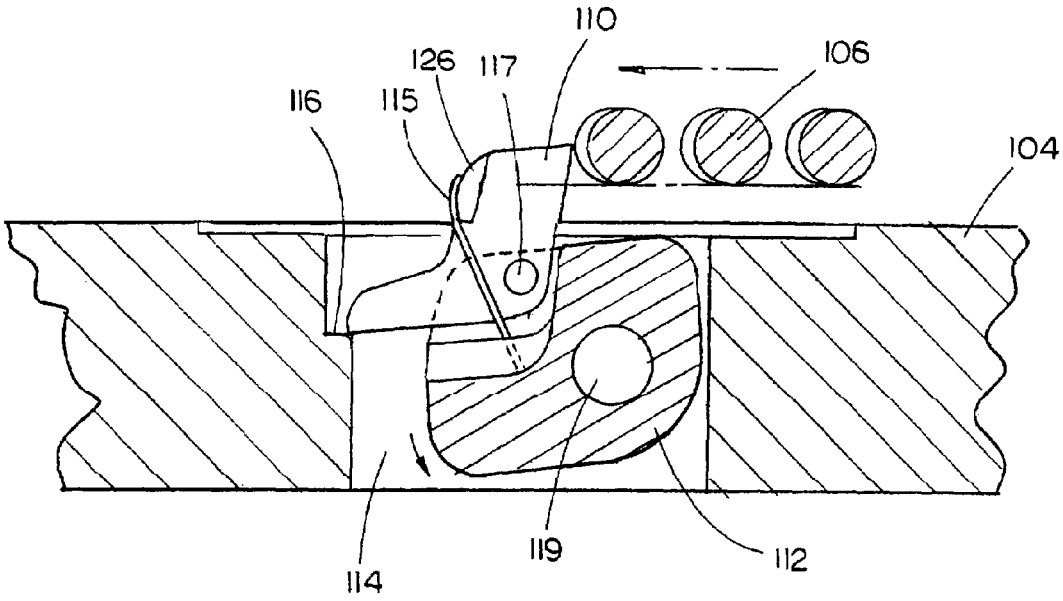

In FIGS. 5A and 5B the nail checker assembly 102 is shown engaging with the collated nail strip 106 of round-head nails. However, in this instance, the base assembly has been positioned to accept only clipped-head nail strips. Therefore, the second probe 110 does not engage the shank of the nail. In this situation the first probe has engaged the nail shank and rotates as far back as it may go. When the first probe has rotated as far back as it may go it contacts the pivoting probe base assembly 112 and initiates rotation in the pivoting probe base assembly 112 as is shown in FIG. 5B. The second probe 110, having not been rotated through engagement with the nail, is rotated into engagement with the lock ledge assembly 116 by the rotation of the pivoting probe base assembly 112. This engagement of the lock ledge assembly 116 by the second probe 110 prevents further rotation of the pivoting probe base assembly 112. Further, the second probe 110 is affixed in a position within the path of the advancing nail strip, thus, the nail strip may contact the second probe 110. This contact with the second probe, along with no further rotation in the pivoting probe base assembly 112, hinders the advancement of the nails past the second probe 110. It is contemplated that the first probe 108 may remain in contact with the nail strip even while the nail strip is being hindered from advancing. It is understood that, while in the present embodiment, the second probe 110 has been described as hindering the advancement of the nail strip, the first probe 108 may also provide such functionality when only the second probe 110 is engaged by the advancing nail strip. Thus, an operator may know that the incorrect nails are being loaded into the adjustable angle magazine 101.

Figure 6:
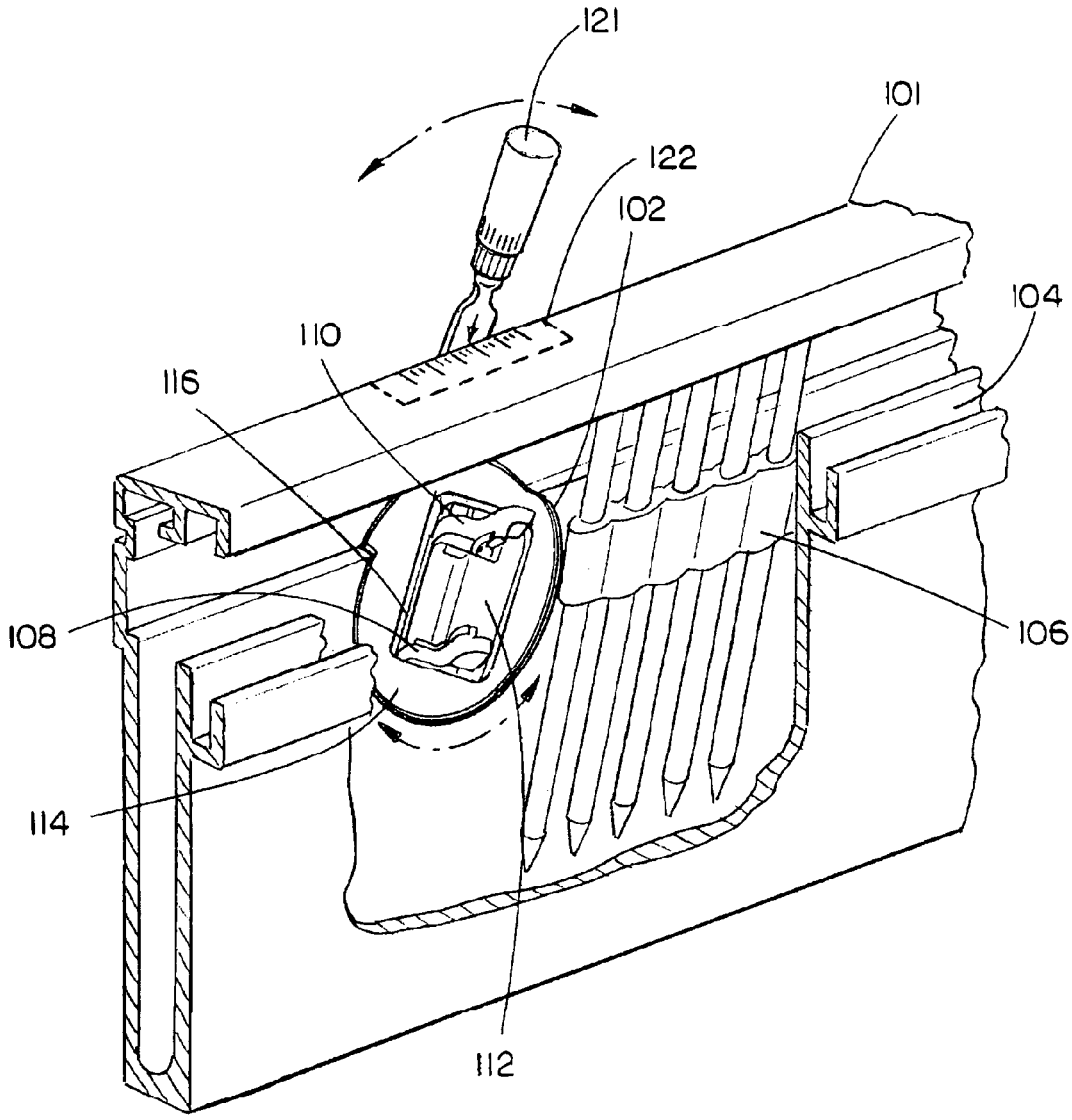
FIG. 6 is an illustration of the nail checker assembly including an adjustment handle for orienting the nail checker assembly in the correct position.

Referring now to FIG. 6 the adjustment handle 121 is shown. The adjustment handle 121 couples with the base assembly 112 and is operational engagement with a readout display 122. The adjustment handle 121 in coordination with the readout display 122 enables an operator to correctly position the nail checker assembly 102 with respect to the type of nail being loaded into the adjustable angle magazine 101. In the current embodiment the adjustment handle 121 enables multiple positions the nail checker assembly 102. In alternative embodiments, the adjustment handle 121 enables a first position which verifies that round-head nails are being loaded into the adjustable angle magazine 101, and a second position which verifies that clipped-head nails are being loaded into the adjustable angle magazine 101. In any position if the incorrect nail type is loaded into the adjustable angle magazine 101, the nail checker assembly 102 may hinder the nails from advancing into the nose casting of the nail gun.

In an alternative embodiment the angle of engagement assembly of the nail checker assembly 102 may be directly linked to the adjustment of the adjustable angle magazine 101. For instance, when utilizing an adjustable angle nail gun, where the nail loading assembly may be adjusted relative to a nose casting assembly of the adjustable angle nail gun, the adjustment of the nail loading assembly may automatically adjust the position of the nail checker assembly. For example, if the nail loading assembly is set to a first angle which allows for round-head nails to be fired from the adjustable angle nail gun, the nail checker assembly may rotate into a position that allows the round-head nails to advance into the nose casting assembly and hinders the advancement of clipped-head nails.

The adjustable angle magazine 100 provides the operator of a nail gun the ability to use a variety of nail types collated at a variety of angles within the same nail gun. The housing 104 is configured generally to appear as a standard nail gun magazine with a cover slidably coupled with it. However, the housing 104 may be configured for operation without the cover. In alternative embodiments, the housing 104 may be coil-type casing where the connected nails are arranged in a long belt, which winds around a spool. The coil-type casing may be configured in a variety of ways, such as a horizontal coil-type casing or a vertical coil-type casing. The cover may be configured to operate with alternative embodiments, such as the coil-type casing, or may not be included. It is understood that alternative design embodiments of the housing 104 and cover may be employed and do not depart from the scope and spirit of the present invention.

Figure 7:
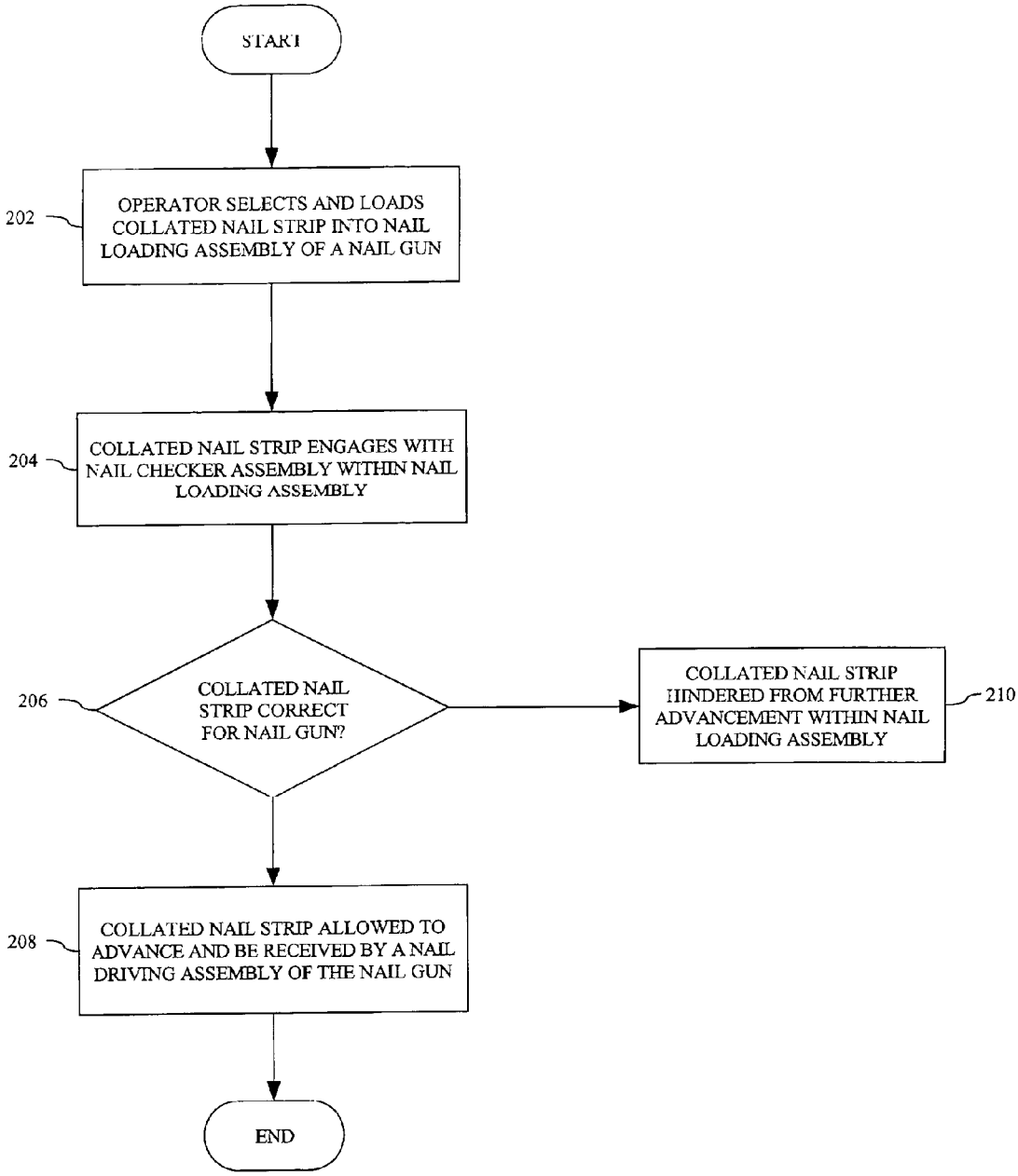
FIG. 7 is a flowchart illustrating a method for using a nail gun by determining whether a collated nail strip is correct for the nail gun.

A method for determining whether a proper collated nail strip is being advanced to a nail driving assembly from a nail loading assembly of a nail gun, is shown in FIG. 7. In a first step 202, the operator of the nail gun initially loads a collated nail strip into the nail loading assembly. It is understood that the collated nail strip may be loaded into a nail loading assembly with various loading configurations, such as rear-loading, top-loading, side-loading, and the like. The nails of the collated nail strip, in step 204, engage with a nail lockout assembly disposed within the nail loading assembly. In step 206 the nail lockout assembly determines if the collated nail strip, which is being advanced through the nail loading assembly to the nail driving assembly for operation upon by the nail driving assembly, is providing the nails in the correct position for the nail gun. If it is determined that the nails being provided are in the correct position for operation upon by the nail driving assembly, then in step 208 the nail lockout assembly allows the collated nail strip to advance. The advancing collated nail strip has the nails received by the nail driving assembly where the nails may be driven. If, however, it is determined that the nails being provided are incorrectly positioned for operation upon by the nail driving assembly, then in step 210 the nail lockout assembly hinders the collated nail strip from advancing by engaging with the nails and locking in position, thereby locking the nail strip in place within the nail gun. When the nail lockout assembly locks in position and hinders further advancement of the collated nail strip, the operator of the nail gun is provided an indication that the collated nail strip the operator selected is incorrect for use with the nail gun.

It is understood that the specific order or hierarchy of steps in the methods disclosed are examples of exemplary approaches. Based upon design preferences, it is understood that the specific order or hierarchy of steps in the method can be rearranged while remaining within the scope and spirit of the present invention. The accompanying method claims present elements of the various steps in a sample order, and are not necessarily meant to be limited to the specific order or hierarchy presented.

It is believed that the present invention and many of its attendant advantages may be understood by the forgoing description. It is also believed that it may be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A nail checker assembly for use with a nail loading assembly of a nail gun, comprising:

a pivoting probe assembly including a first probe and a second probe for engaging a nail advancing within the nail loading assembly;

a pivoting probe base assembly coupled with the pivoting probe assembly, the pivoting probe base assembly for enabling rotation of the pivoting probe assembly;

a base assembly coupled with the pivoting probe base assembly and the nail loading assembly, the base assembly for enabling rotation of the pivoting probe base assembly; and a lock ledge assembly coupled with the base assembly, the lock ledge assembly being suitable for providing a stop by engaging with the pivoting probe assembly when the nail engages with only one of the probes of the pivoting probe assembly, wherein the pivoting probe assembly allows the nail to advance when the nail engages with both the first and second probes of the pivoting probe assembly;

wherein the pivoting probe assembly hinders the nail from advancing when the nail engages with only one of the probes of the pivoting probe assembly by causing the pivoting probe assembly to engage against the lock ledge assembly, thereby preventing further advancement of the nail within the nail gun.

2. The nail checker assembly of claim 1, wherein the nail checker assembly further comprises an angle of engagement assembly for placing the nail checker assembly in a desired position.

3. The nail checker assembly of claim 1, wherein the pivoting probe assembly further comprises a first tensioning assembly coupled with the pivoting probe base assembly and operationally coupled with the first probe and a second tensioning assembly coupled with the pivoting probe base assembly and operationally coupled with the second probe.

4. The nail checker assembly of claim 1, wherein the nail checker assembly is disposed within an adjustable angle magazine.

5. The nail checker assembly of claim 4, wherein the adjustable angle magazine further comprises an articulating pusher assembly.

6. The nail checker assembly of claim 4, wherein the adjustable angle magazine is a top-load magazine or a side-load magazine.

7. The nail checker assembly of claim 1, wherein the nail gun is selected from the group consisting of a spring-loaded nail gun, a pneumatic nail gun, an electromagnetic nail gun, a combustion nail gun, and a motor driven nail gun.

8. A nail checker assembly for use with a nail loading assembly of a nail gun, comprising:

means for engaging a nail advancing within the nail loading assembly; and means for hindering the nail from advancing if the advancing nail is misaligned.

9. The nail checker assembly of claim 8, wherein the means for engaging a nail is a pivoting probe assembly coupled with a pivoting probe base assembly coupled with a base assembly, wherein the pivoting probe assembly operationally engages with the advancing nail within the nail loading assembly.

10. The nail checker assembly of claim 8, wherein the means for hindering the nail from advancing is a lock ledge coupled with the base assembly, the lock ledge being contacted by the pivoting probe assembly when the advancing nail is misaligned.

11. The nail checker assembly of claim 8, wherein the nail loading assembly further comprises an articulating pusher assembly.

12. The nail checker assembly of claim 8, wherein the nail loading assembly is a top-load or side-load magazine.

13. The nail checker assembly of claim 8, wherein the nail gun is selected from the group consisting of a spring-loaded nail gun, a pneumatic nail gun, an electro-magnetic nail gun, a combustion nail gun, and a motor driven nail gun.

* * * * *